US008593362B2

(12) United States Patent
Shea et al.

(10) Patent No.: US 8,593,362 B2
(45) Date of Patent: Nov. 26, 2013

(54) MULTI BAND TELEMETRY ANTENNA FEED

(75) Inventors: Donald F. Shea, Allen, TX (US); Ofir Nahshon, Kfar Pinec (IL); Joe Pein, Ramat Gan (IL); Izik Krepner, Naharia (IL); George R. Blake, Monrovia, CA (US)

(73) Assignee: Orbit Communication System Ltd., Netanya (IL)

( * ) Notice: Subject to any disclaimer, the term of this patent is extended or adjusted under 35 U.S.C. 154(b) by 492 days.

(21) Appl. No.: 12/910,889

(22) Filed: Oct. 25, 2010

(65) Prior Publication Data

US 2011/0291903 A1 Dec. 1, 2011

Related U.S. Application Data

(60) Provisional application No. 61/348,817, filed on May 27, 2010.

(51) Int. Cl.
*H01Q 13/00* (2006.01)

(52) U.S. Cl.
USPC ..... 343/785; 343/779

(58) Field of Classification Search
USPC ..... 343/756, 762, 772, 776, 786, 779, 785
See application file for complete search history.

(56) References Cited

U.S. PATENT DOCUMENTS

| | | | | |
|---|---|---|---|---|
| 4,041,499 | A * | 8/1977 | Liu et al. | 343/756 |
| 5,793,334 | A * | 8/1998 | Anderson et al. | 343/786 |
| 5,907,309 | A * | 5/1999 | Anderson et al. | 343/786 |
| 6,720,932 | B1 * | 4/2004 | Flynn et al. | 343/786 |
| 7,038,632 | B2 * | 5/2006 | Webb et al. | 343/781 P |
| 7,102,581 | B1 * | 9/2006 | West | 343/762 |

* cited by examiner

*Primary Examiner* — Hoanganh Le
(74) *Attorney, Agent, or Firm* — Mark M. Friedman

(57) ABSTRACT

A multi band antenna feed, for supporting multiple frequency bands, is coupled to a reflector and includes a cylindrical core waveguide and at least three coaxial cylinders, encircling said cylindrical core waveguide and forming at least three coaxial waveguides, bounded between pairs of consecutive coaxial cylinders. The cylindrical core waveguide and the at least three coaxial waveguides provide a pair of sum and difference radiation patterns, for each frequency band: a C-band, an S-band and an L-band.

18 Claims, 15 Drawing Sheets

600

700

MULTI BAND TELEMETRY ANTENNA FEED

CROSS-REFERENCE TO RELATED APPLICATIONS

This application claims priority of Provisional Patent Application 61/348,817, filed May 27, 2010.

FIELD AND BACKGROUND OF THE INVENTION

The present invention relates to an antenna feed and, more particularly, to an antenna feed adapted for simultaneous transmission, reception and tracking in multiple designated frequency bands of the telemetry spectrum.

The telemetry spectrum is required for transmission of real time data from a test vehicle to ground. The traditional telemetry frequency bands, located between 1400 to 2400 MHz, are extensively used for both commercial and military flight-testing activities. Additional frequency spectrum allocations for aeronautical mobile telemetry, for flight-testing are located in the C-band (4400 to 6700 MHz).

Antennas available for telemetry, employing multiple frequency bands for communication, require interchangeable separate feeds for transmission and/or reception of each of the frequency bands in use. Changing a frequency band, supported by a prior art antenna for data transmission or reception, requires a physical removal of the antenna feed from the reflector focal point and a physical installation of a new antenna feed and associated RF equipment, that support the new frequency band, into the focal point of the reflector. This installation procedure is a time consuming process and may result in misalignment of the reflector and antenna feed causing distorted antenna radiation patterns.

Antennas with separate feeds, each operating in a single frequency band, can be used in conjunction with a dichroic sub reflector, wherein one feed is located at the main reflector focus and a second feed is located at the sub reflector focus. Current telemetry tri-band solutions utilize an LIS-band feed at the main reflector's focal point and a C-band feed at the sub-reflector's focal point. This configuration tends to be inherently narrow band. Furthermore, the sub reflector blocks part of the antenna radiation, especially in mobile antennas with small main reflectors. Imperfections of the dichroic material also result in gain reduction due to some attenuation of the signal at the wavelengths where the signal should pass unattenuated through the material and some transmission through the material at those wavelengths for which the material has to be a perfect reflector. This configuration also requires sub reflector redesign, as to match each main reflector specified for use.

U.S. Pat. No. 4,041,499 describes a direction finding (DF) coaxial antenna that supports at least two frequency bands. The DF antenna of U.S. Pat. No. 4,041,499 is not configured for receive, transmit and tracking of telemetry applications and thus is not required to be coupled to a reflector that poses limitations on the feed dimensions.

It would be highly advantageous to have a single compact feed for efficient and simultaneous reception, transmission and tracking in multiple frequency bands, in conjunction with a reflector. It would be also highly advantageous to have a method for a modular and easy installation and upgrade of a telemetry ground antenna, by replacing an existing feed, with a single multi band feed that supports more or other frequency bands in addition to the currently employed frequency band (s).

SUMMARY OF THE INVENTION

The present invention provides an antenna feed that enables a communication antenna, together with its accompanying radio frequency circuitry, to simultaneously receive, track and transmit at three or more contiguous or non-contiguous frequency bands.

According to the present invention there is provided a multi band antenna feed, for supporting multiple frequency bands. The multi band antenna feed is coupled to a reflector and includes a cylindrical core waveguide and at least three coaxial cylinders, encircling said cylindrical core waveguide and forming at least three in coaxial waveguides, bounded between pairs of consecutive coaxial cylinders. The cylindrical core waveguide and the at least three coaxial waveguides provide a pair of sum and difference radiation patterns, for each frequency band: a C-band, an S-band and an L-band.

The multi band antenna feed includes impedance matching irises, in a shape of circular rings that encircle all or part of the coaxial cylinders. The impedance matching irises are adapted to slide along axes of the coaxial cylinders which they respectively encircle.

The impedance matching irises may have various sizes. For example, one impedance matching iris may have a height that differs from a height of another impedance matching iris. Furthermore, one impedance matching iris may have a width that differs from a width of another impedance matching iris.

The diameters of the at least three coaxial waveguides and the cylindrical core waveguide are determined based on cut-off frequencies associated with the multiple frequency bands supported by each waveguide.

The diameters are further determined based on a focal to diameter parameter of the reflector that is coupled to the multi band antenna feed.

The cylindrical core waveguide may be loaded with a dielectric material and the diameter of the cylindrical core waveguide is determined based on a dielectric constant of the dielectric material.

Once one diameter of one waveguide is determined, other diameters of other waveguides are determined based on this one diameter.

Each of the coaxial waveguides includes multiple input ports, disposed around a circumference of the coaxial waveguide, for supporting $TE_{11}$ and $TE_{21}$ propagation modes in the each coaxial waveguide.

There may be eight input ports, radially disposed around an outer surface of each coaxial waveguide, at angular intervals of 45° from each other.

Alternatively, there may be eight input ports disposed in a circle centered on a rear side of the each coaxial waveguide, at angular intervals of 45° from each other.

The multi band antenna feed further includes multiple coupling ridges, respectively coupled to the multiple input ports of at least one coaxial waveguide.

The coupling ridges may have various shapes, such as: a ramp, steps or any descending curve.

According to the present invention, there is provided a multi band tracking antenna, that includes a first multi band antenna feed, facing a reflector and a second multi band antenna feed, facing an opposite direction of the reflector and adapted for acquisition in any of a C-band, an S-band and an L-band.

The first multi band antenna feed and the second multi band antenna feed includes: a cylindrical core waveguide and at least three coaxial cylinders, encircling the cylindrical core waveguide and forming at least three coaxial waveguides, bounded between pairs of consecutive coaxial cylinders. The cylindrical core waveguide and the at least three coaxial waveguides provide a pair of sum and difference radiation patterns, for each of the C-band, the S-band and the L-band.

The first multi band antenna feed and the second multi band antenna feed includes impedance matching irises, in a shape of circular rings that encircle all or part of the coaxial cylinders.

The impedance matching irises are adapted to slide along axes of the coaxial cylinders which they respectively encircle.

The diameters of the at least three coaxial waveguides and cylindrical core waveguide of the first multi band antenna feed are determined based on a focal to diameter parameter of the reflector.

BRIEF DESCRIPTION OF THE DRAWINGS

Various embodiments are herein described, by way of example only, with reference to the accompanying drawings, wherein.

DESCRIPTION OF THE PREFERRED EMBODIMENTS

Figure 1A:
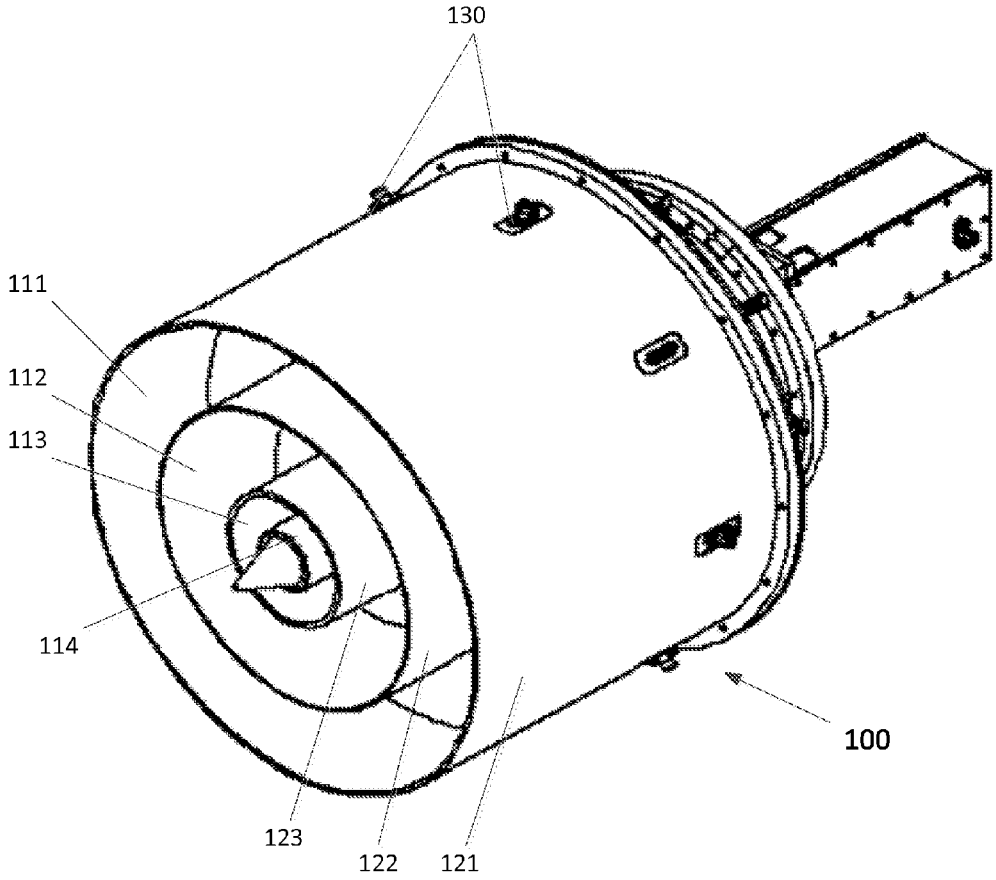
FIG. 1A is a perspective view of a multi band antenna feed, according to an embodiment of the invention.

The principles and operation of a multi band antenna feed according to the present invention may be better understood with reference to the drawings and the accompanying description.

The present invention provides a multi band antenna feed for simultaneous reception, transmission and tracking in any of multiple designated telemetry frequency bands. The multi band antenna feed maintains good isolation between the multiple frequency bands, which may be either contiguous or non-contiguous bands. The multi band antenna feed is designed to be installed at a reflector focal point and can easily replace an installed antenna feed, in order to upgrade frequencies supported by a ground telemetry antenna. The beam pattern of the multi band antenna feed is designed to illuminate the reflector with an f/D ratio (ratio of reflector focal length to diameter) ranging from 0.35 to 0.5 optimally for a high G/T (antenna gain-to-noise-temperature) value, a factor which is all important for telemetry antennas.

The multi band antenna feed includes a cylindrical core waveguide, encircled by a plurality of hollow coaxial cylinders. The hollow coaxial cylinders are conductive and form a plurality of coaxial waveguides, bounded between pairs of consecutive hollow coaxial cylinders. Each coaxial waveguide has an annular cylindrical cavity, with an inner radius and circumference defined by an inner coaxial cylinder and an outer radius and circumference defined by an outer coaxial cylinder. The number of coaxial waveguides defines the number of frequency bands supported.

Each waveguide operates independently and is isolated from the others. The waveguides are arranged to have their phase centers collocated at a single point with a deviation of not more than one quarter of a wavelength of the highest frequency specified. This simplifies the design of new reflector antennas where all feeds must have their phase centers at the reflector focal point. It also simplifies upgrading of existing antennas.

The multi band antenna feed supports monopulse tracking and thus should support propagation of a sum ($\Sigma$) and difference ($\Delta$) radiation patterns for each of the multiple frequency bands supported by the multi band antenna feed.

The cylindrical core waveguide is adapted to provide a sum radiation pattern of a highest level frequency band supported by the multi band antenna feed. The highest level frequency band is defined as the frequency band that covers the highest frequencies while the lowest level frequency band is the frequency band that covers the lowest frequencies.

The outermost coaxial waveguide is adapted to provide a difference radiation pattern of the lowest level frequency band supported by the multi band antenna feed.

Intermediate coaxial waveguides are defined as the coaxial waveguides disposed between the cylindrical core waveguide and the outermost coaxial waveguide. Each of the intermediate coaxial waveguides is adapted to provide two radiation patterns: a difference radiation pattern of one of the frequency bands and a sum radiation pattern of a next lower level frequency band.

For example: a multi band antenna feed that supports n frequency bands includes n coaxial waveguides and one cylindrical core waveguide, i.e. a total of n+1 waveguides. All the waveguides provide, all together, n pairs of sum and difference radiations patterns, one pair for each of the n frequency bands. The cylindrical core waveguide provides a sum radiation pattern for the highest level frequency band, i.e. an $n^{th}$ frequency band. The outermost coaxial waveguide, also referred to as a first coaxial waveguide, provides a difference radiation pattern of the lowest level frequency band, also referred to as a first frequency band. An intermediate coaxial waveguide number i provides two radiation patterns: a sum radiation pattern of an $(i-1)^{th}$ frequency band and a difference radiation pattern of an frequency band.

In order to support the sum and difference radiation patterns, field distributions are generated within the coaxial waveguides known as the $TE_{11}$ (Transverse Electric) mode and the $TE_{21}$ mode, which are the first two higher order propagation modes, after the fundamental TEM mode, of a coaxial waveguide.

The dimensions of the waveguides are dictated by two factors: (i) the cutoff frequencies associated with each of the bands supported; and (ii) The characteristics of a reflector coupled to the multi band antenna feed. Since the multi band antenna feed is adapted to operate in conjunction with a reflector, the angle at which the multi band antenna feed should illuminate the reflector, in order to fully cover the reflector surface, is determined by the f/D (focal distance to diameter) parameter of the reflector. The desired illumination angle poses limitations on the maximum circumferences of the waveguides and dictates a compact size of the multi band antenna feed. The goal of reducing the dimensions of the multi band antenna feed is achieved by adjustable impedance matching elements disposed within the waveguides.

The compact size of the multi band antenna feed minimizes blockage of the radiation emanating from the main reflector. The minimized blockage contributes to an improved G/T and sidelobe levels and hence minimum distortion of the antenna radiation pattern is achieved. Thus, the multi band antenna feed can be efficiently employed with small mobile reflectors used normally in telemetry ranges.

According to an embodiment of the invention, a multi band tracking antenna is provided. The multi band tracking antenna includes a pair of multi band antenna feeds, wherein one multi band antenna feed is facing a reflector and the other multi band antenna feed is facing the opposite direction. The latter multi band antenna feed provides a wide angle of view for initial acquisition of targets, while the former multi band antenna feed operates in conjunction with the reflector for narrow angle tracking once locked on to a target.

Referring now to the drawings, the following description and drawings refers to an embodiment of three frequency bands: L-band, S-band and a C-band of the telemetry spectrum. It should be noted that any other amount of frequency bands can be implemented and any other frequency bands can be supported.

Figure 1B:
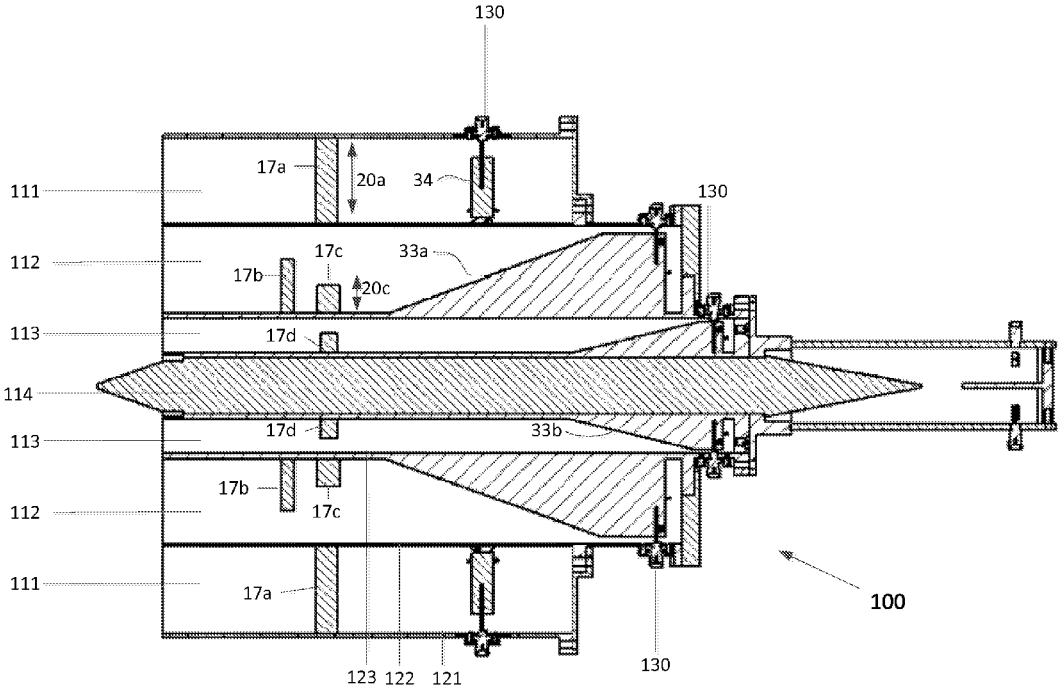
FIG. 1B is a cutaway side view of a multi band antenna feed, according to an embodiment of the invention.

FIG. 1A is a perspective view of a multi band antenna feed 100 and FIG. 1B is a cut away view of multi band antenna feed 100. Multi band antenna feed 100 includes a cylindrical core waveguide 114, located on the central axis of feed 100, encircled by three hollow conducting cylinders 121, 122 and 123 which respectively forms three coaxial waveguides 111, 112 and 113. Coaxial waveguide 111 is an outermost waveguide and is bounded between hollow cylinder 121 and hollow cylinder 122; coaxial waveguide 112 is an intermediate waveguide that is bounded between hollow cylinder 122 and hollow cylinder 123; and coaxial waveguide 113 is bounded between hollow cylinder 123 and cylindrical core waveguide 114.

Since multi band antenna feed 100 has three coaxial waveguides (and a total of four waveguides, including cylindrical core waveguide 114), it can support three frequency bands, in this case: the L-band, S-band and the C-band.

Optionally, cylindrical core waveguide 114 is filled with a dielectric material 16. The dielectric loading facilitates reducing the diameter of cylindrical core waveguide 114, and may be omitted when not required.

Each of the coaxial waveguides has multiple input ports, also referred to as coax to waveguide ports, evenly dispersed, around the circumference of each coaxial waveguide. Multi band antenna feed 100 of FIGS. 1A and 1B includes radial coax to waveguide ports, such as input ports 130 that are radially disposed around the outer surface of each coaxial cylinder. Multi band antenna feed 100' of FIG. 1C includes rear coax to waveguide ports, such as input ports 130', disposed in a circle centered on a rear side of each coaxial waveguide.

Figure 1C:
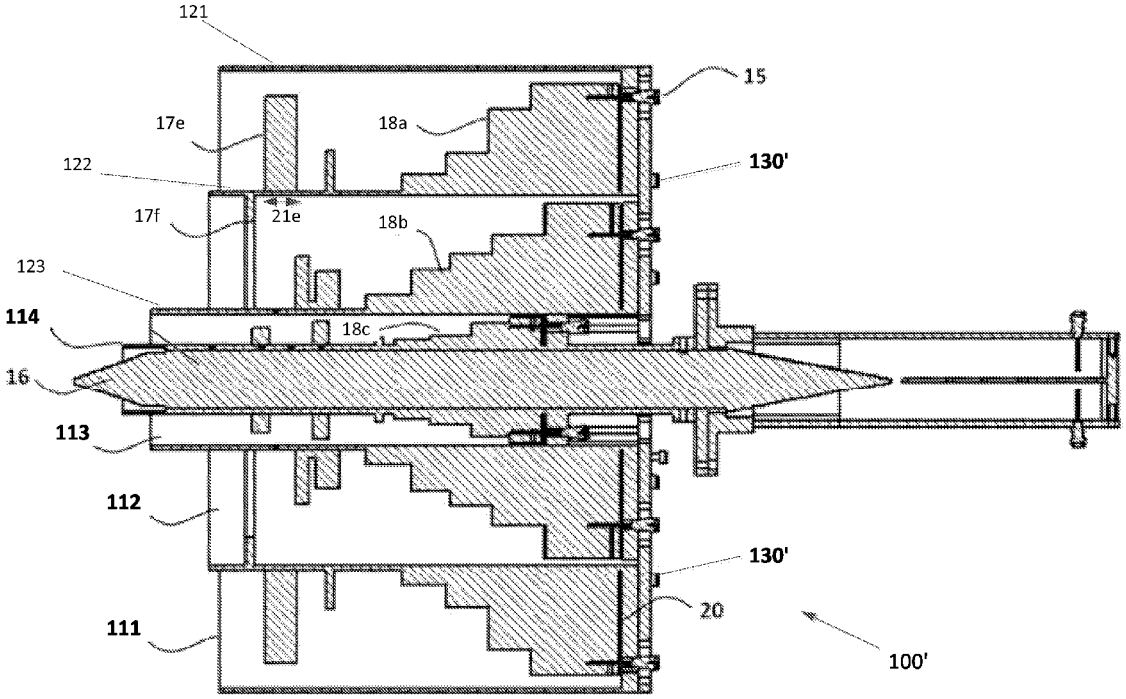
FIG. 1C is a cutaway side view of a multi band antenna feed, according to another embodiment of the invention.

FIG. 1C shows coax to waveguide transitions 15 for signal input to the coaxial waveguides. Each of input ports 130 or 130' is adapted to the coaxial waveguide for minimum return loss. This adaptation may be achieved by using coupling ridges, wherein each coupling ridge is coupled to one input port and to an inner cylinder of the coaxial waveguide.

The coupling ridges may have various shapes and sizes, such as stepped ridges, ramp ridges or any other descending curve or form described by a polynomial or any other descending mathematical function. FIG. 1C illustrates rear fed stepped ridges, collectively denoted 18 of various shapes and sizes. Stepped ridge 18*a* is coupled to one input port 130' of coaxial waveguide 111. There are multiple stepped ridges 18*a* within coaxial waveguide 111, each is coupled to one input port of coaxial waveguide 111; Stepped ridge 18*b* is coupled to one input port 130' of coaxial waveguide 112. There are multiple stepped ridges 18*b* within coaxial waveguide 112, each is coupled to one input port of coaxial waveguide 112; and Stepped ridge 18*c* is coupled to one input port 130' of coaxial waveguide 113. There are multiple stepped ridges 18*c* within coaxial waveguide 113, each is coupled to one input port of coaxial waveguide 113.

FIG. 1B illustrates ramp ridges, also referred to as fin line transitions, collectively denoted 33. Ramp ridge 33*a* is coupled to one input port 130 within coaxial waveguide 112, while ramp ridge 33*b* is coupled to one input port 130 within coaxial waveguide 113. There are multiple ramp ridges 33*a* within coaxial waveguide 112, each is coupled to one input port of coaxial waveguide 112 and there are multiple ramp ridges 33*b* within coaxial waveguide 113, each is coupled to one input port of coaxial waveguide 113.

Stepped ridges 18 and ramp ridges 33 in each coaxial waveguide are isolated from the back wall by means of air gaps 20.

FIGS. 1B and 1C also shows a multiplicity of impedance matching irises, collectively denoted 17, in the shape of circular annular rings that encircle each of the waveguides. The impedance matching irises may have various thicknesses and radii and are disposed at various positions along the inner cylinder of each waveguide. Impedance matching iris 17*a* (FIG. 1B) is located within coaxial waveguide 111 and encircles coaxial cylinder 122. Impedance matching iris 17*a* is thick and occupies the whole distance between coaxial cylinders 121 and 122, as demonstrated by an up down arrow 20*a* that indicates a width of impedance matching iris 17*a*. Impedance matching iris 17*c* is much thinner and its width is demonstrated by an up down arrow 20*c*. Impedance matching iris 17*e* (FIG. 1C) is located within coaxial waveguide 111 and encircles coaxial cylinder 122. Impedance matching iris 17*e* is relatively high comparing to impedance matching iris 17*f*. The height of impedance matching iris 17*e* is demonstrated by a right left arrow 21*e*. Impedance matching irises 17*a*-17*e* can be located in various locations along the axes of the waveguides.

The impedance matching irises are required for both input and aperture matching and for achieving good VSWR over all the bands. The impedance matching irises are constructed using various materials such as metallic conductors and dielectric materials. The impedance matching irises may be manually adjustable, by sliding the impedance matching irises along the cylinder to which they are coupled. The axial translation may be used for fine tuning the input impedance of each coaxial cavity, during manufacturing or field installation. The impedance matching irises may be fixed to their positions, which may be adjusted during manufacturing. It should be noted that for these contiguous closely spaced telemetry bands the antenna cannot be matched at all without these irises or other types of impedance matching elements.

FIG. 1B shows two alternative implementations of coax to waveguide transitions that may be used. The coax to waveguide transitions in FIG. 1B are radially fed probe transitions 34 within coaxial waveguide 111 and also radially fed probe transitions 130 adapted by fin line transitions 33 within coaxial waveguides 112 and 113.

Cylindrical core waveguide 114 is fed by means of either a septum polarizer, if dual circular polarization is required or an OMT (otho-mode transducer) for dual linear polarization or any other means of feeding a cylindrical antenna known in the art.

Figure 2:
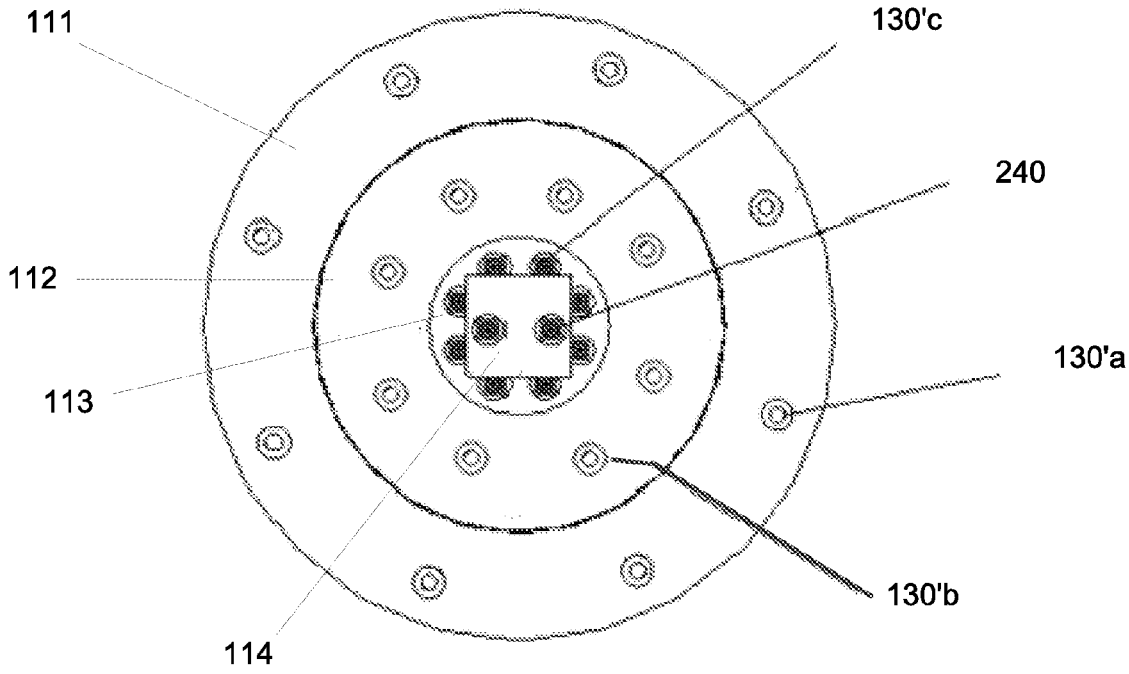
FIG. 2 is a schematic rear view of a multi band antenna feed, according to an embodiment of the invention.

FIG. 2 is a schematic rear view of multi band antenna feed 100' of FIG. 1C. Two output ports 240 of a waveguide septum polarizer are coupled to cylindrical core waveguide 114 for transmission or reception of either Right Hand Circular Polarization (RHCP) or Left Hand Circular Polarization (LHCP) of the sum signal in the C-band.

Input ports 130'C are coupled to coaxial waveguide 113 which radiates the $TE_{11}$ sum mode for the S-band and the $TE_{21}$ difference mode for the C-band. Input ports 130'C are disposed in a circle centered on the axis of the feed at regular angular intervals of 45° to each other.

Input ports 130'B are coupled to coaxial waveguide 112 which radiates the $TE_{11}$ sum mode for the L-band and the $TE_{21}$ difference mode for the S-band and upper L-band. The eight input ports 130'B are disposed in the next circle of ports also at regular angular intervals of 45° to each other.

Input ports 130'A are coupled to coaxial waveguide 111 which radiates the $TE_{21}$ difference mode for the lower L-band. The eight input ports 130'A are disposed in the outermost circle of ports again at regular angular intervals of 45° to each other.

Figure 3A:
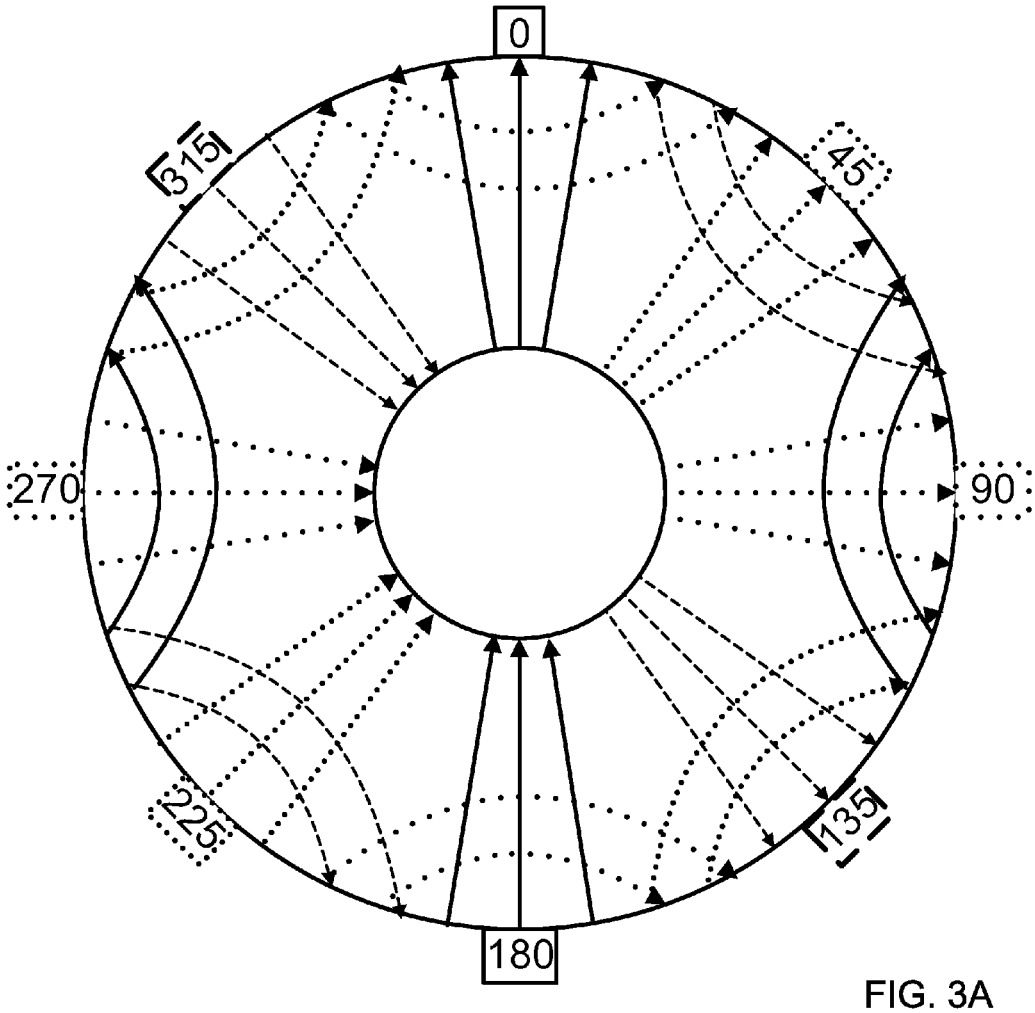
FIG. 3A illustrates electrical phases to be imposed at input ports of a coaxial waveguide in $TE_{11}$ mode.
Figure 3B:
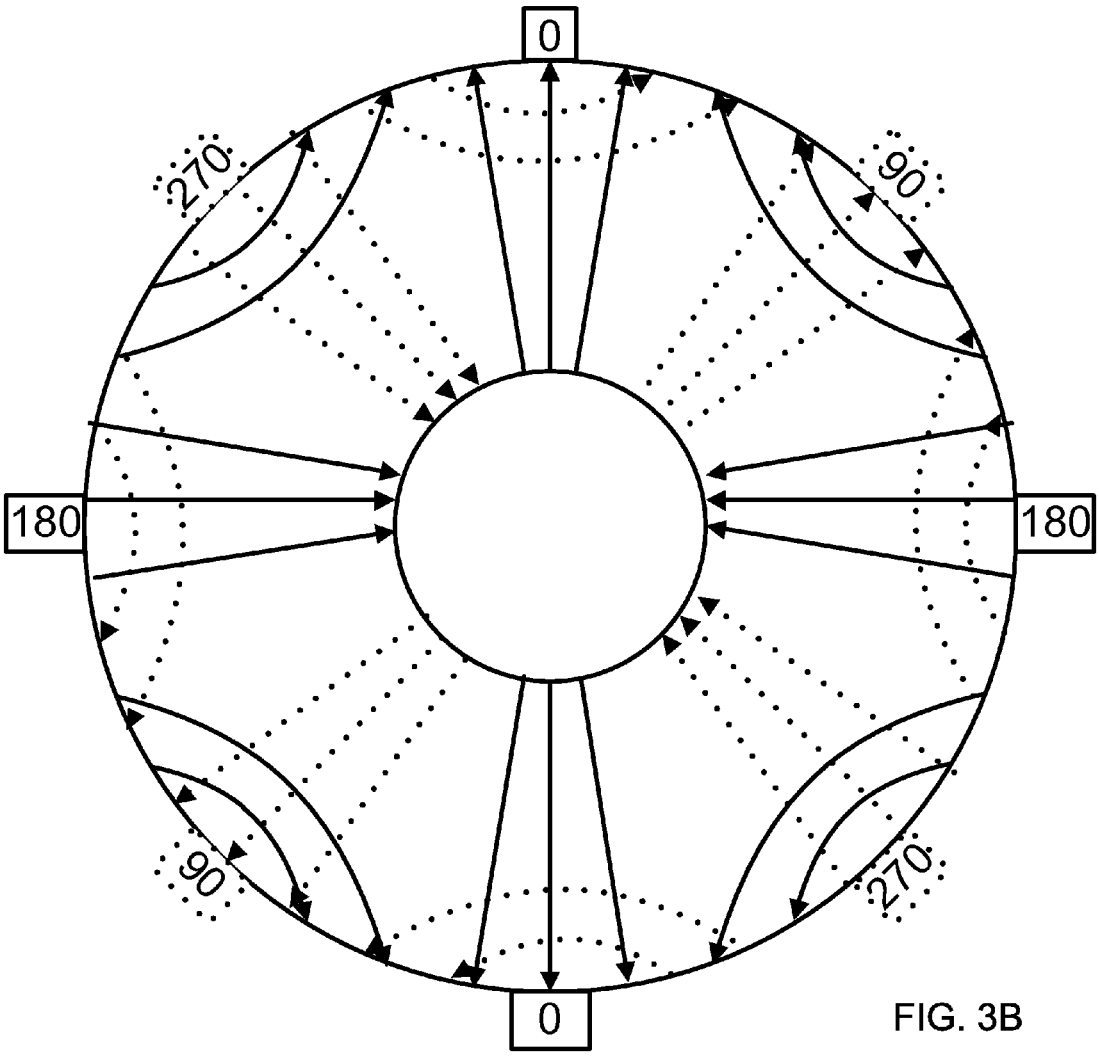
FIG. 3B illustrates electrical phases to be imposed at input ports of a coaxial waveguide in $TE_{21}$ mode.

FIG. 3A schematically shows, the electrical phases to be imposed at each of the input ports, of each of coaxial waveguides 112-113, in order to generate the $TE_{11}$ waveguide modes, required for the sum radiations patterns. FIG. 3B schematically shows, the electrical phases to be imposed at each of the input ports, of each of coaxial waveguides 111-113, in order to generate the $TE_{21}$ waveguide modes, required for the difference radiations patterns. These phases are produced by means of RF circuits employing hybrid couplers.

Two orthogonally polarized $TE_{11}$ modes, when fed in phase quadrature, produce dual circularly polarized sum patterns, while two orthogonally polarized $TE_{21}$ modes, when fed in phase quadrature, produce dual circularly polarized difference patterns at the same frequency.

Figure 4:
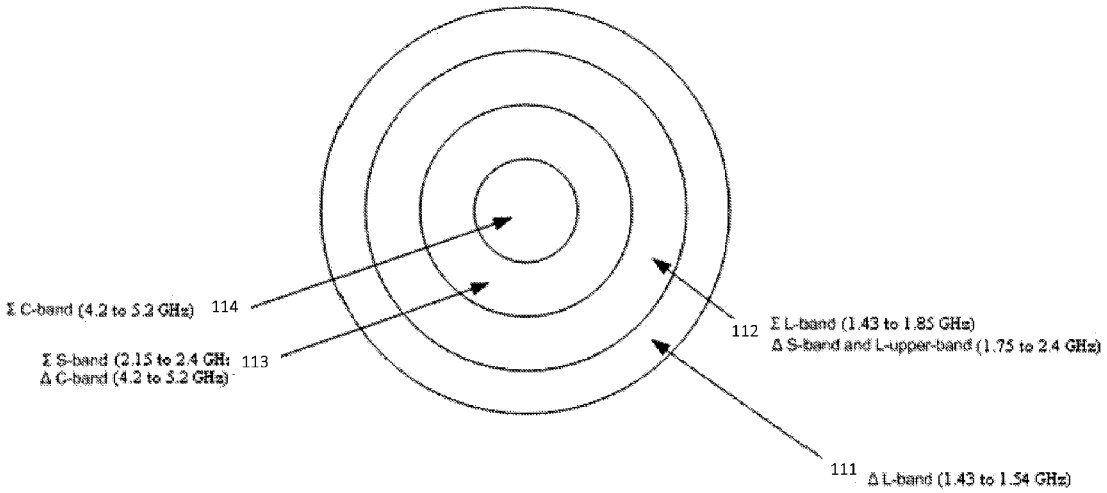
FIG. 4 is schematic cross section diagram of a multi band antenna feed.

FIG. 4 is a schematic cross section diagram of multi band antenna feed 100 that supports three bands: L, S and C-band. FIG. 4 lists the radiation patterns supported by each of the four waveguides.

Intermediate coaxial waveguides, such as a second coaxial waveguide 112 and a third coaxial waveguide 113 are used to radiate two antenna patterns each: a difference (Δ) antenna pattern is radiated together with the sum (Σ) pattern of the next lower frequency band. Third coaxial waveguide 113 generates both the sum (Σ) S-band (which is a second level frequency band) and the difference (Δ) C-band (which is a third and highest level frequency band). Second coaxial waveguide 112 generates both the sum (Σ) L-band (which is a first and lowest level frequency band) and the difference (Δ) S-band and upper L-band.

An outermost waveguide, in this case coaxial waveguide 111 may also produce two antenna patterns: a difference (Δ) antenna pattern and a sum (Σ) pattern, however only the lower L-band difference antenna pattern is used.

An innermost waveguide, in this case cylindrical core waveguide 114 produces only the C-band circularly polarized sum antenna pattern.

Table 1 shows the frequency bands of each of the waveguides of multi band antenna feed 100, according to a preferred embodiment. The cutoff wavelength, λc, for the $TE_{11}$ mode in a coaxial waveguide, having an annular cylindrical cavity, wherein 'a' is the radius of an inner conducting cylinder and 'b' is the radius of an outer conducting cylinder, is given by the formula:

$$\lambda c=1.873*\pi/2*(b+a) \quad \text{(i)}$$

The cutoff wavelength, λc, for the $TE_{21}$ mode in the coaxial waveguide is given by the equation:

$$\lambda c=1.023*\pi/2*(b+a) \quad \text{(ii)}$$

The cutoff frequency for a circular cylindrical waveguide, wherein c is the dielectric constant of the material filling the waveguide, is:

$$\lambda c=3.414*b*\sqrt{\in}$$

TABLE 1

| Coaxial Waveguide | Frequency Band Sum ($TE_{11}$) [GHz] | Frequency Band Difference ($TE_{21}$) [GHz] |
|---|---|---|
| 114 (core) | 4.2 to 5.2 | N/A |
| 113 | 2.15 to 2.4 | 4.2 to 5.2 |
| 112 | 1.43 to 1.85 | 1.75 to 2.4 |
| 111 (outmost) | N/A | 1.43 to 1.54 |

The diameter of cylindrical core waveguide 114, as well as the diameters of cylinders 121-123 (that form coaxial waveguides 111, 112 and 113) are based on: (i) a cutoff frequency of the frequency band supported by each waveguide; and (ii) The focal length to diameter (f/D) parameter of the reflector that is coupled to multi band antenna feed 100. The beam width of a beam radiated from a waveguide is inversely proportional to the diameter of the radiating aperture where the diameter is measured in wavelengths λ. The beam width depends on the wavelength and a diameter of the waveguide such that for a given wavelength, the smaller the waveguide's diameter is, the wider the beam gets. The diameter of each waveguide is determined, such that a beam that exits the waveguide will fully cover the reflector surface.

A diameter of cylindrical core waveguide 114 is determined based on: (i) the cutoff frequency associated with the frequency band supported by cylindrical core waveguide 114; (ii) dielectric constant of the material filling waveguide 114; and (iii) the f/D characteristic of the reflector. The diameter of the next waveguide, coaxial waveguide 113, is determined based on the diameter that was set for cylindrical core waveguide 114 in addition to (i) the cutoff frequency associated with the frequency band supported by coaxial waveguide 113; and (ii) the f/D characteristic of the reflector. So that each outer diameter of each waveguides is determined based on a previously set diameter of another waveguide (if at least one diameter was already determined), a cutoff frequency and a f/D factor of the reflector.

The diameter of cylindrical core waveguide 114 and the dielectric constant of the material filling cylindrical core waveguide 114 will determine in accordance with equation (3) the cutoff frequency for this waveguide. The cutoff frequency should be less than a lowest frequency of this band (4.2 GHz). The cutoff frequency for cylindrical core waveguide 114 is set at 3.9 GHz.

A diameter of coaxial cylinder 123, that forms an outer surface of coaxial waveguides 113 in conjunction with the diameter previously set for cylindrical core waveguide 114, determines cutoff frequency for this waveguide in accordance with equation (1) for the TE11 mode and with equation (2) for TE21 mode. The cutoff frequency should be less than the lowest frequency of this band 2.15 GHz for the TE11 mode and 4.2 GHz for the TE21 mode. The cutoff frequency for this waveguide is set at 2.00 GHz for the TE11 mode and 3.9 GHz for the TE21 mode.

A diameter of coaxial cylinder 122, that forms an outer surface of coaxial waveguides 112 in conjunction with the diameter previously set for the inner surface, e.g. the diameter coaxial cylinder 123 determines a cutoff frequency for this waveguide in accordance with equation (1) for the TE11 mode and with equation (2) for TE21 mode. The cutoff frequency should be less than lowest frequency of this band 1.43 GHz for the TE11 mode and 1.75 GHz for the TE21 mode. The cutoff frequency for this waveguide is set at 0.849 GHz for the TE11 mode and 1.55 for the TE21 mode.

A diameter of coaxial cylinder 121, that forms an outer surface of coaxial waveguides 111 in conjunction with the diameter previously set for the inner surface, e.g. the diameter coaxial cylinder 122 determines a cutoff frequency for this waveguide in accordance with equation (1) for the TE11 mode and with equation (2) for TE21 mode. The cutoff frequency should be less than a lowest frequency of this band (1.43 GHz). The cutoff frequency is set at 0.80 GHz for the TE21 mode.

Figure 7:
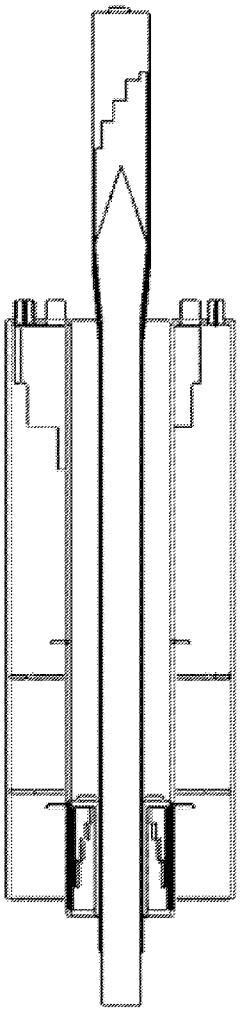
FIG. 7 is a schematic cross section diagram of a multi band antenna feed that supports S and X bands, according to another embodiment of the invention.
Figure 8:
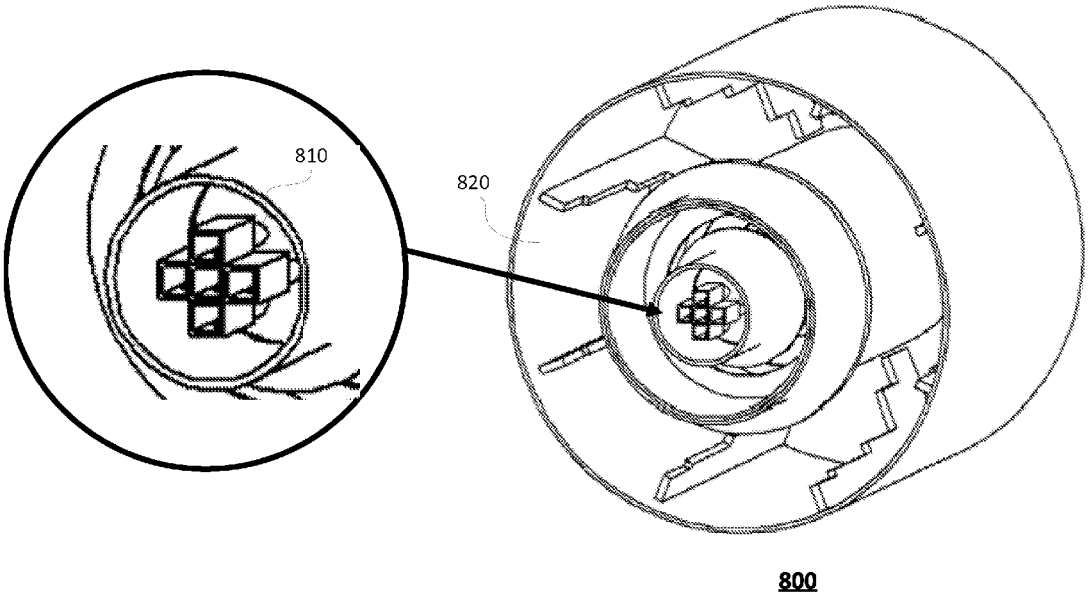
FIG. 8 is a perspective view diagram of a multi band antenna feed that supports S and Ka bands, according to yet another embodiment of the invention.

FIGS. 7 and 8 illustrate multi band antenna feeds that support other frequency bands. FIG. 7 is a schematic diagram of a multi band antenna feed 700 that supports an S and X bands to which were applied the same design principles.

FIG. 8 is a schematic diagram of a multi band antenna feed 800 that supports S and Ka bands. A Ka band array 810 is a traditional five horn monopulse antenna feed, surrounded by a coaxial waveguide 820 which is an S-band auto-tracking feed. Collocating a phase center of Ka band array 810 at a phase center of coaxial waveguide 820 does not result in mutual interference as a result of the wide gap in their frequency bands.

Multi band feed 100 (or 100') can facilitate the modification or redesigning of a feed with its supporting electronics, that is required to support additional frequency bands. For example: existing telemetry stations, which do not have a C-band capability, can be upgraded without replacing the reflector(s) or the pedestal which are by far the largest subsystems of the antenna.

Figure 5A:
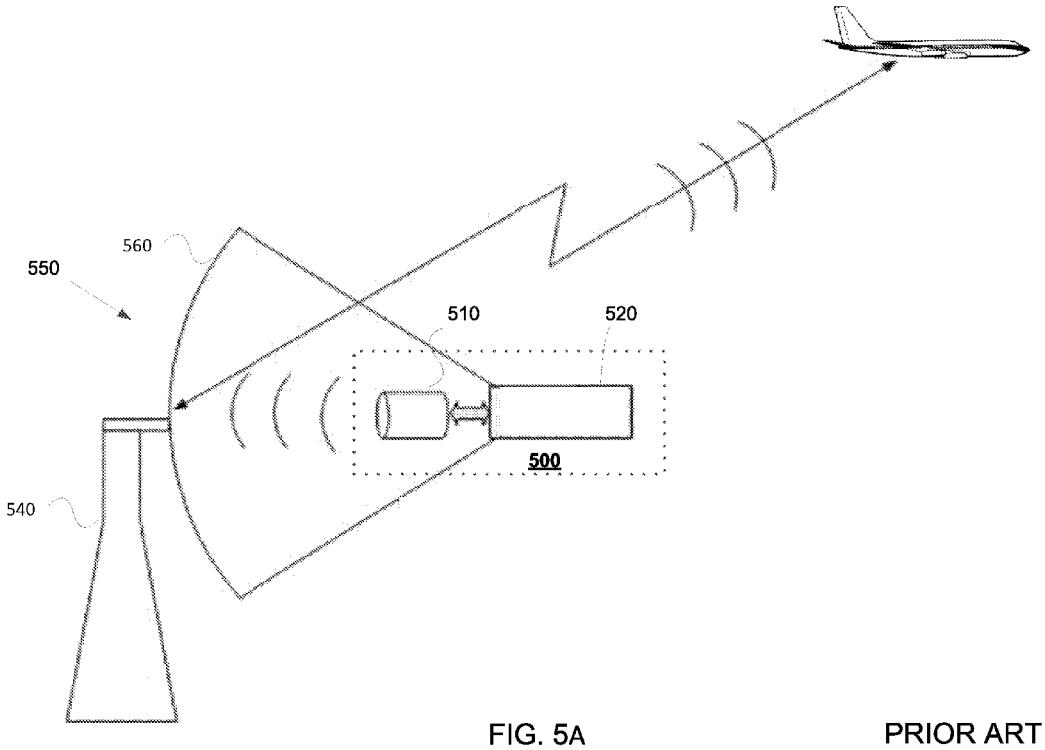
FIG. 5A PRIOR ART
FIG. 5A is a schematic diagram of a typical telemetry ground antenna.

FIG. 5A is a schematic diagram of a typical telemetry ground antenna 550 in a telemetry range that supports only L and S bands. Telemetry ground antenna 550 includes a reflector 560, a pedestal 540 and a feed subsystem 500. Feed subsystem 500 includes the feed 510 and a radio frequency circuitry, such as RF front end 520.

Amongst the functions of RF front end 520 there are: (i) Frequency band selection as selected by the operator; (ii) Frequency up and down conversion from a base frequency to a current frequency of radiation and reception; (iii) Electrical phase differentiation, where the correct electrical phases are produced for each input port as indicated in FIG. 3A and FIG. 3B in order to generate the required coaxial cavity modes; (iv) Antenna beam scanning for target tracking; and (v) Signal polarization as selected by the operator.

In order to upgrade telemetry ground antenna 550 for supporting a new frequency band, such as the C-band, one option is to only replace feed 510 with multi band antenna feed 100, which may be optionally adapted to meet any special requirements for any of the frequency bands by selecting and positioning the adjustable impedance matching irises. Some adjustments, that will be clear to those skilled in the art, should be made to the configuration of RF front end 520. Another option is to replace both the feed and the RF front end.

Figure 5B:
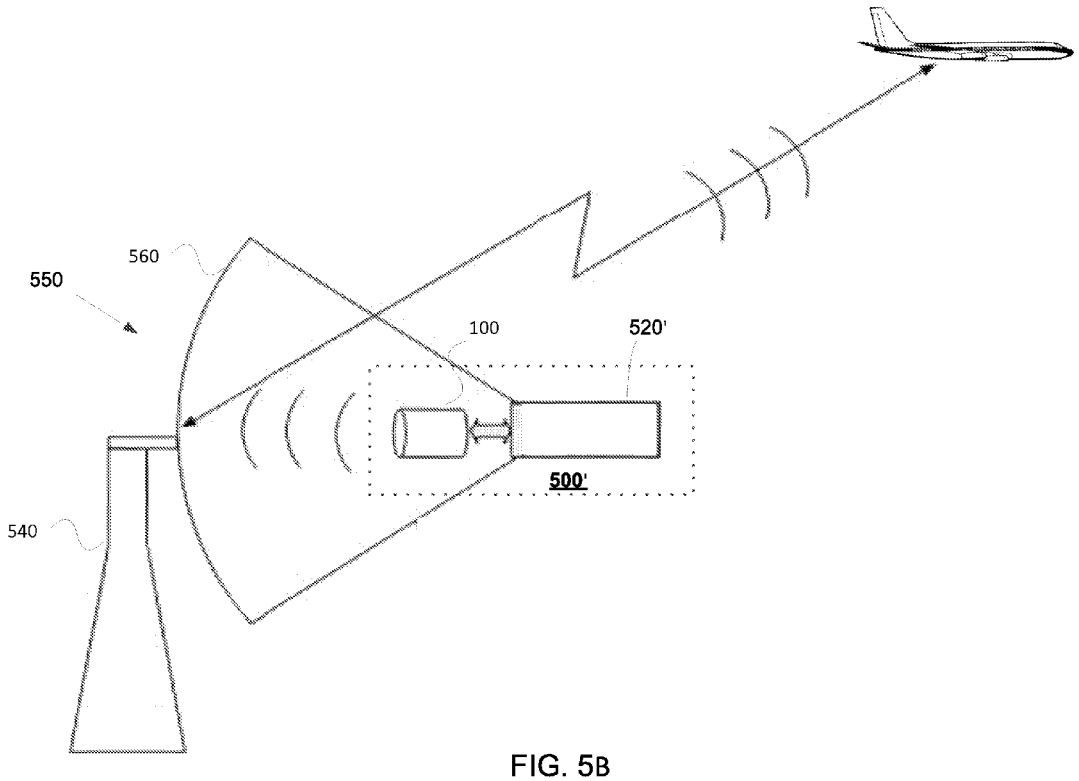
FIG. 5B is a schematic diagram of a telemetry ground antenna, according to an embodiment of the invention.

No further changes are required to the telemetry ground antenna 550, as the RF front end reduces the L, S and C band frequency spectrums to a single base-band frequency spectrum at its output. FIG. 5B illustrates telemetry ground antenna 550' after the upgrading, which looks the same as in FIG. 5A, except that a feed system 500' includes multi band antenna feed 100 that replaces feed 510. RF front end 520' may be RF front end 520 of FIG. 5A with some adjustments.

Figure 6:
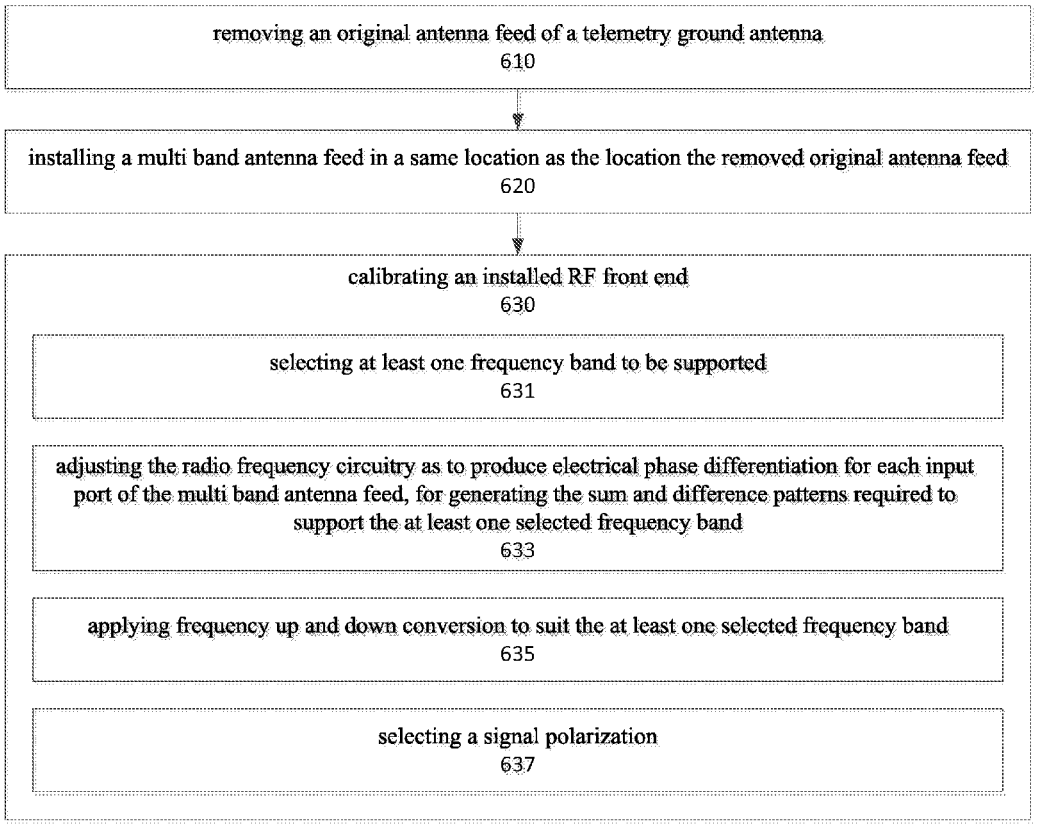
FIG. 6 is a flowchart illustrating a method for upgrading a telemetry ground antenna, according to an embodiment of the invention.

FIG. 6 illustrates a method 600 for installing a multi band antenna feed in a telemetry ground antenna without replacing the reflector(s) or the pedestal. Me 600 can also be used for upgrading a telemetry ground antenna that has a feed which needs to be replaced, so as to support more frequency bands.

Me 600 begins with a stage 610 of removing an original antenna feed of a telemetry ground antenna. Stage 610 may be omitted in a case of a first installation.

Stage 610 is followed by a stage 620 of installing a multi band antenna feed in a same location as the location the removed original antenna feed. Stage 620 may include manually adjusting impedance matching irises by sliding the irises along the cylinders surrounded by the irises. The adjusting of the impedance matching irises is for optimizing the multi band antenna feed in order to obtain the best possible results at the required frequencies. Typically, the location of the removed original antenna feed, as well as the location of the newly installed multi band antenna feed is the focal point of a reflector, preferably a main reflector.

Stage 620 is followed by a stage 630 of coupling the input ports, of each of the coaxial waveguides of the multi band antenna feed, to an installed radio frequency circuitry assembly and calibrating the installed radio frequency circuitry. Stage 630 further includes coupling the output ports of the cylindrical core waveguide. The new calibration may suit, for example, requirements of the test range.

Stage 630 includes: stage 631 of selecting at least one frequency band to be supported; stage 633 of adjusting the radio frequency circuitry assembly as to produce the required electrical phase differentiation for each input port of the multi band antenna feed, for generating the sum and difference patterns required to support the at least one selected frequency band; stage 635 of applying frequency up and down conversion to suit the at least one selected frequency band; and stage 637 of selecting a signal polarization. The polarization may be a dual circular polarization or a dual linear polarization or both.

The above procedure should be repeated for all the required frequency bands.

Figure 9:
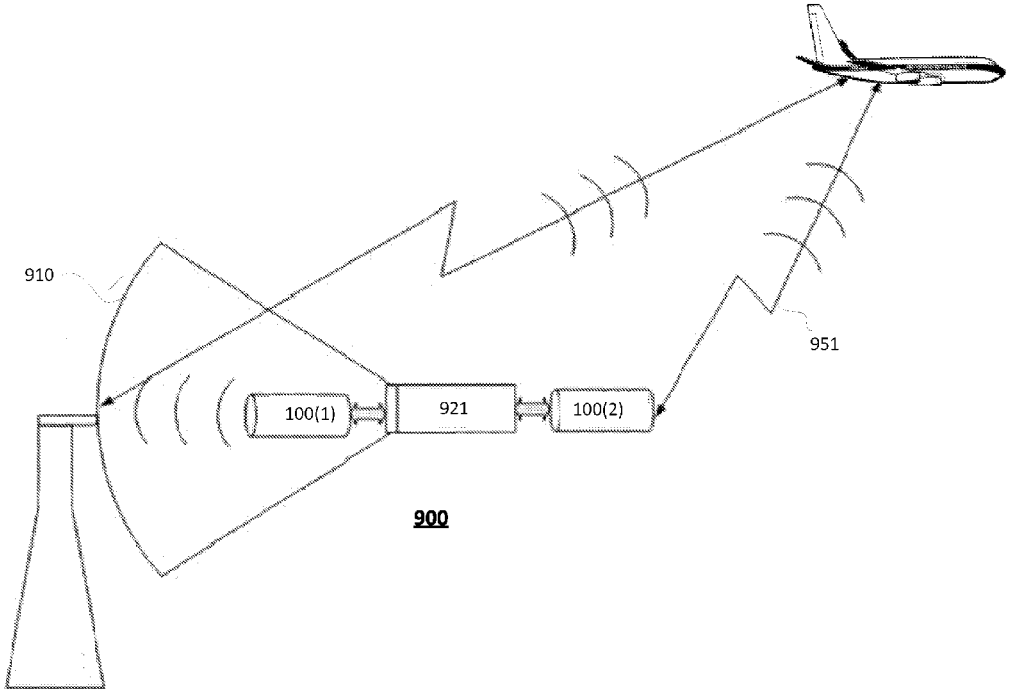
FIG. 9 is a schematic diagram of a telemetry tracking antenna, according to an embodiment of the invention.

FIG. 9 illustrates a multi band tracking antenna 900 that includes two multi band antenna feeds 100 arranged in a back to back configuration. A first multi band antenna feed 100(1) is facing a reflector 910 and is substantially located in a focal point of reflector 910. First multi band antenna feed 100(1) is coupled to reflector 910 and to a RF circuitry 921. A second multi band antenna feed 100(2) is facing an opposite direction of reflector 910 and is coupled to the same RF circuitry 922, but may also use separate RF circuitry.

Second multi band antenna feed 100(2) operates as an independent acquisition antenna with a wide angle of view for initial acquisition of targets. Second multi band antenna feed 100(2) transmits and receive in a direction denoted as 951. First multi band antenna feed 100(1) operates in conjunction with reflector 910 for narrow angle tracking once second multi band antenna feed 100(2) locked on to a target.

Multi band tracking antenna 900 is adapted for tracking multiple telemetry bands, such as: C-band, S-band and L-band. Each of multi band antenna feeds 100 supports multiple telemetry bands, such as: C-band, S-band and L-band. It should be noted that current solutions that support three telemetry bands cannot support a back to back configuration, since the C-band feed is implemented as a separate feed located at a sub reflector focal point and is not integrated in one composite feed as in multi band antenna feed 100. The operator may select the active feed: either the second multi band antenna feed when acquisition is required or the first multi band antenna feed when tracking is required.

Figure 10:
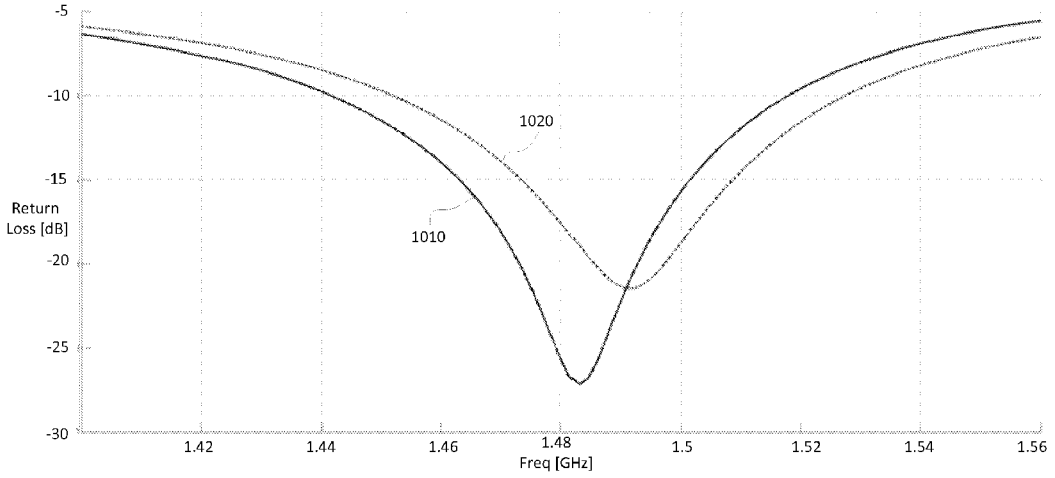
FIG. 10 is a graph illustrating a simulation result for assisting in impedance adjusting, according to an embodiment of the invention.

The applicants executed a simulation for finding optimal adjustments of the impedance matching irises. FIG. 10 shows a graph of a simulation result, illustrating an adjustment of the frequency band represented by curve 1010, by altering the thickness of the iris 17*e* by 4 mm, to give an altered frequency band as represented by curve 1020.

Figure 11:
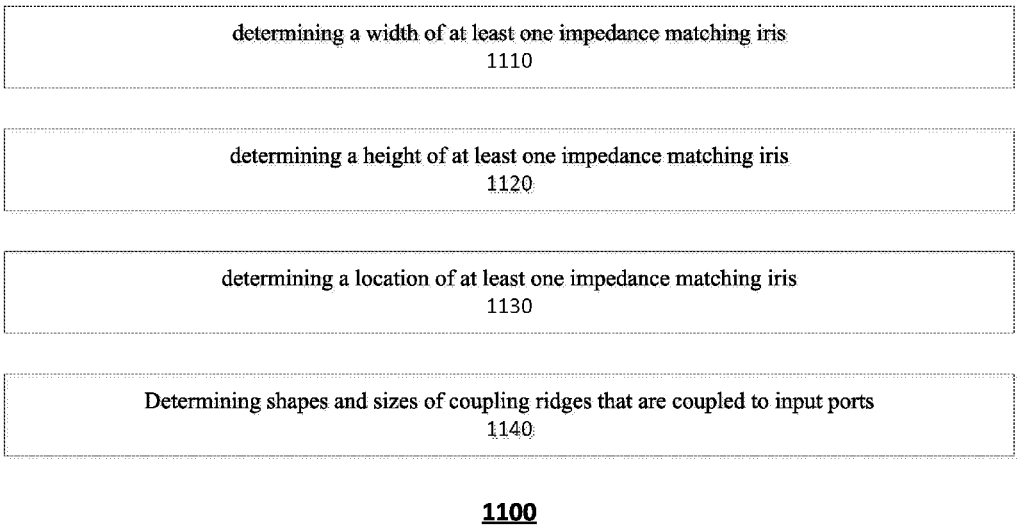
FIG. 11 is a flowchart illustrating a method for manufacturing a multiband antenna feed, according to an embodiment of the invention.

FIG. 11 illustrates a method 1100 for manufacturing a multi band antenna feed. Me 1100 includes various stages for adjusting impedance matching irises and coupling ridges.

Method 1100 includes a stage 1110 of determining a width of at least one impedance matching iris. An example of a width of an impedance matching iris is demonstrated by arrows 20*a* and 20*e* of FIG. 1B.

A stage 1120 includes determining a height of at least one impedance matching iris. An example of a height of an impedance matching iris is demonstrated by arrow 21*c* of FIG. 1C.

A stage 1130 includes determining a location of at least one impedance matching iris. The location determination includes selecting a coaxial cylinder that the impedance matching iris will be coupled to. The location determination further includes selecting the location along the coaxial cylinder. The impedance matching iris encircles the selected coaxial cylinder at the selected location along the coaxial cylinder.

A stage 1140 includes determining a shape and size of coupling ridges that are coupled to input ports. A coupling ridge may have a shape of a ramp, steps or any descending curve or form described by a polynomial or any other descending mathematical function. The slope of the ramp or the height and widths of the steps may also be determined. The shape and size of coupling ridges may vary among the multiple coaxial waveguides.

Further details of producing an antenna are well-known in the art and need not be detailed herein.

According to an embodiment of the invention, a method for designing a multi band antenna feed includes stages 1110-1140.

While the invention has been described with respect to a limited number of embodiments, it will be appreciated that many variations, modifications and other applications of the invention may be made. Therefore, the claimed invention as recited in the claims that follow is not limited to the embodiments described herein.

What is claimed is:

1. A multi band antenna feed, for supporting multiple frequency bands, comprising:

(a) a cylindrical core waveguide;

(b) at least three coaxial cylinders, encircling said cylindrical core waveguide and forming at least three coaxial waveguides, bounded between pairs of consecutive coaxial cylinders; and (c) at least eight input ports radially disposed around an outer surface of said at least three coaxial waveguides, thereby supporting TE11 and TE21 propagation modes in each of said at least three coaxial waveguides and providing a pair of sum and difference radiation patterns, for each frequency band: a C-band, an S-band, and an L-band.

2. The multi band antenna feed of claim 1, further comprising impedance matching irises, in a shape of circular rings, encircling at least one coaxial cylinder.

3. The multi band antenna feed of claim 2, wherein said impedance matching irises are adapted to slide along an axis of said at least one coaxial cylinder.

4. The multi band antenna feed of claim 1, wherein diameters of said at least three coaxial waveguides and a diameter of said cylindrical core waveguide are determined based on cutoff frequencies associated with said multiple frequency bands.

5. The multi band antenna feed of claim 1, wherein diameters of said at least three coaxial waveguides and a diameter of said cylindrical core waveguide are determined based on a focal length to diameter ratio parameter of said reflector.

6. The multi band antenna feed of claim 1, wherein said cylindrical core waveguide is loaded with a dielectric material and wherein a diameter of said cylindrical core waveguide is determined based on a dielectric constant of said dielectric material.

7. The multi band antenna feed of claim 1, wherein a diameter of a coaxial waveguide is determined based on a diameter of another coaxial waveguide.

8. The multi band antenna feed of claim 1, wherein said at least eight input ports are radially disposed around an outer surface of each of said at least three coaxial waveguides, at angular intervals of 45° from each other.

9. The multi band antenna feed of claim 1, wherein said at least eight input ports are disposed in a circle centered on a rear side of said each coaxial waveguide, at angular intervals of 45° from each other.

10. The multi band antenna feed of claim 1, further comprising multiple coupling ridges, respectively coupled to said at least eight input ports of at least one coaxial waveguide.

11. The multi band antenna feed of claim 10, wherein said coupling ridges have a shape, selected from a list consisting of: a ramp, steps and a descending curve.

12. The multi band antenna feed of claim 1, further comprising:

(d) a reflector, wherein the multi band antenna feed is installed at a reflector focal point so that the multi band antenna feed beam pattern illuminates the reflector with an f/D ratio (ratio of reflector focal length to diameter) ranging from 0.35 to 0.5.

13. A multi band tracking antenna, comprising:

(a) a first multi band antenna feed, facing a reflector; and (b) a second multi band antenna feed, facing an opposite direction of said reflector, adapted for acquisition in any of a C-band, an S-band and an L-band;

wherein said first multi band antenna feed and said second multi band antenna feed comprising:

(i) a cylindrical core waveguide;

(ii) at least three coaxial cylinders, encircling said cylindrical core waveguide and forming at least three coaxial waveguides, bounded between pairs of consecutive coaxial cylinders; and (iii) at least eight input ports radially disposed around an outer surface of each of said at least three coaxial waveguides thereby supporting TE11 and TE21 propagation modes in each of said at least three coaxial waveguides and providing a pair of sum and difference radiation patterns, for each of the C-band, the S-band, and the L-band.

14. The multi band tracking antenna of claim 13, wherein said first multi band antenna feed and said second multi band antenna feed comprising impedance matching irises, in a shape of circular rings that encircle coaxial cylinders.

15. The multi band tracking antenna of claim 14, wherein said impedance matching irises are adapted to slide along axes of said coaxial cylinders which they respectively encircle.

16. The multi band tracking antenna of claim 13, wherein diameters of said at least three coaxial waveguides and cylindrical core waveguide of said first multi band antenna feed are determined based on a focal length to diameter ratio parameter of said reflector.

17. The multi band tracking antenna of claim 13, wherein said first multi band antenna feed and said second multi band antenna feed are coupled to a same radio frequency circuitry.

18. The multi band tracking antenna of claim 13 wherein said second multi band antenna feed acquisition is initial target acquisition in a wide search angle, followed by switching to narrow angle tracking using said first multi band antenna feed.

* * * * *